United States Patent [19]

Moss

[11] Patent Number: 4,807,246

[45] Date of Patent: Feb. 21, 1989

[54] APPARATUS FOR TREATMENT OF PARTICULATE MATERIAL

[75] Inventor: John A. Moss, Johannesburg, South Africa

[73] Assignee: Carbon Activators (Proprietary) Limited, Johannesburg, South Africa

[21] Appl. No.: 43,543

[22] Filed: Apr. 28, 1987

[30] Foreign Application Priority Data

Apr. 29, 1986 [ZA] South Africa ..... 86/3187

[51] Int. Cl.[4] ..... H05B 3/60

[52] U.S. Cl. ..... 373/120; 373/58

[58] Field of Search ..... 373/58, 120, 122

[56] References Cited

U.S. PATENT DOCUMENTS 2,161,916 6/1939 Erdmann ..... 373/58

4,192,962 3/1980 Nakao et al. ..... 373/120

*Primary Examiner*—Roy N. Envall, Jr.

*Attorney, Agent, or Firm*—Browdy & Neimark

[57] ABSTRACT

A furnace for treating granular activated carbon comprises a single vertical column having a pair of electrodes arranged at vertically spaced locations within the column. The electrodes extend across the column and are so constructed that the particulate material can pass with ease through the electrodes. Suitable connectors connect the electrodes to a source of rectified three phase electric power. Pointed prongs are provided below the upper electrode. A valve controls the outlet from the column so that the furnace can operate continuously. A central cone is provided above the outlet to control the flow of granular carbon down the column.

6 Claims, 3 Drawing Sheets

APPARATUS FOR TREATMENT OF PARTICULATE MATERIAL

This invention relates to apparatus for treatment of particulate material and in particular for activating or re-activating carbon for use in carbon-in-pulp or carbon-in-leach processes and other purposes.

BACKGROUND OF THE INVENTION

One known such apparatus is described in South African Patent Specification No. 83/4727 (Rintoul). It comprises three heating columns within which the particulate material to be heated is contained and three pairs of electrodes arranged respectively within the columns, the electrodes being connected to a three phase power supply so that current can pass through the material in the columns to heat such material. This apparatus operates on batch production with the contents of the columns treated individually and then discharged.

Another such known apparatus is described in U.S. Pat. No. 4,192,962 (Nakao). This is a device for very small scale production with a high electric power to mass of carbon treated ratio. It comprises a pair of electrodes in the form of annular rings arranged axially spaced from one another and located against the side of a single column with the inside edges of the electrodes spaced from the inner wall of the column. Further such apparatusses are disclosed in U.S. Pat. Nos. 4,624,003 (Eirich et al) and 4,261,857 (Nakao) where the electrodes are arranged axially above each other but with the electrodes located at the sides of the column. In U.S. Pat. No. 4,261,857 (Nakao) there is also shown a column with the electrodes at the same level and the same arrangement is shown in U.S. Pat. No. 3,025,385 (Tanaka).

I have found that great care is required to ensure even heating of the granules across the area of the column especially when it is desired that the column should treat the granules on a continuous basis.

SHORT DESCRIPTION OF THE INVENTION

Therefore there is provided according to an aspect of the present invention apparatus for treating particulate material comprising a single vertical column; a pair of electrode means arranged at vertically spaced locations within the column, the electrode means extending across the column and being so constructed that the particulate material can pass with ease through the electrode means. The apparatus further comprises in use means for connecting the electrodes to a source of electric power.

Preferably the electrode means extend horizontally across the column and preferably comprise a grid. This grid can conveniently be formed of graphite rods which are pinned together but preferably is constituted by a graphite plate which is punched to form the grid structure. Prongs having pointed lower ends preferably depend from the grid to minimise tthe effect of sparking across the material.

The column is preferably provided with an inlet, an outlet and an outlet valve controlling the outlet. The valve is conveniently arranged so that the particulate material can pass continuously through the column. An equalising cone is preferably provided below the lower of the electrode means to improve the flow of particulate material through the column.

Steam injection means is preferably provided in the column below the lower electrode means to cool the material. The steam also passes up the column and reacts with the carbon in accordance with the following nett reaction $$C+H_2O \rightarrow CO+H_2$$

The various volatiles will also be released during heating of the particulate material and these volatiles will also be carried up the column. The steam and the gasses mentioned above further provides excellent heat distribution for the particulate materials.

A hopper is preferably provided above the inlet to facilitate supply of material to the column. Drying means is preferably provided to dry the particulate materials prior to its introduction into the column.

An embodiment of the invention will now be described by way of exmple with reference to the accompanying drawings in which certain dimensions are exaggerated in the interest of clarity.

SHORT DESCRIPTION OF THE DRAWINGS

FIG. 1 is a longitudinal section through a column of the invention, and

FIGS. 2 and 3 are respectively sections on line 2—2 and 3—3 of FIG. 1 showing the upper and lower electrodes.

DESCRIPTION OF PREFERRED EMBODIMENT

Figure 1A:
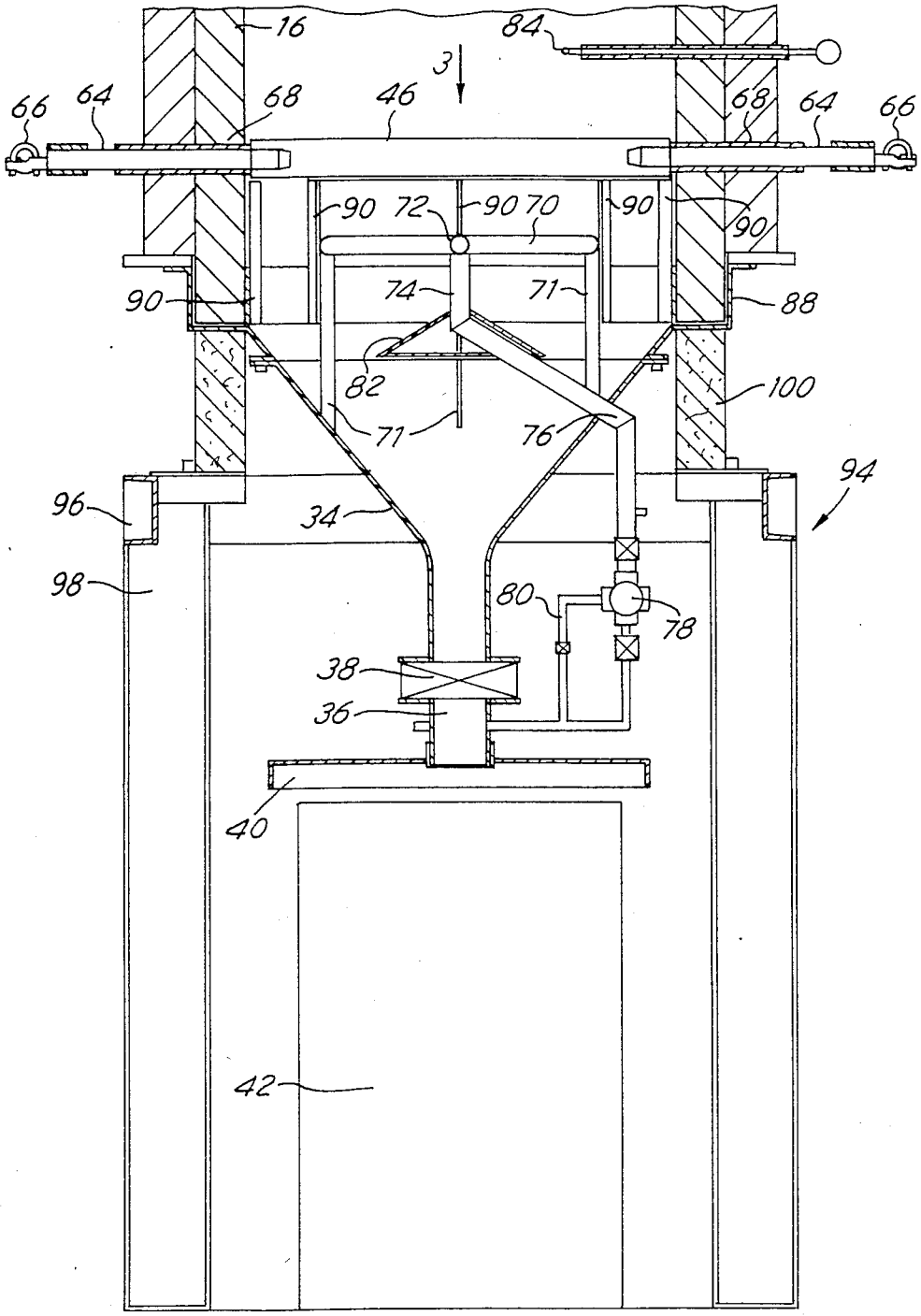
Figure 1B:
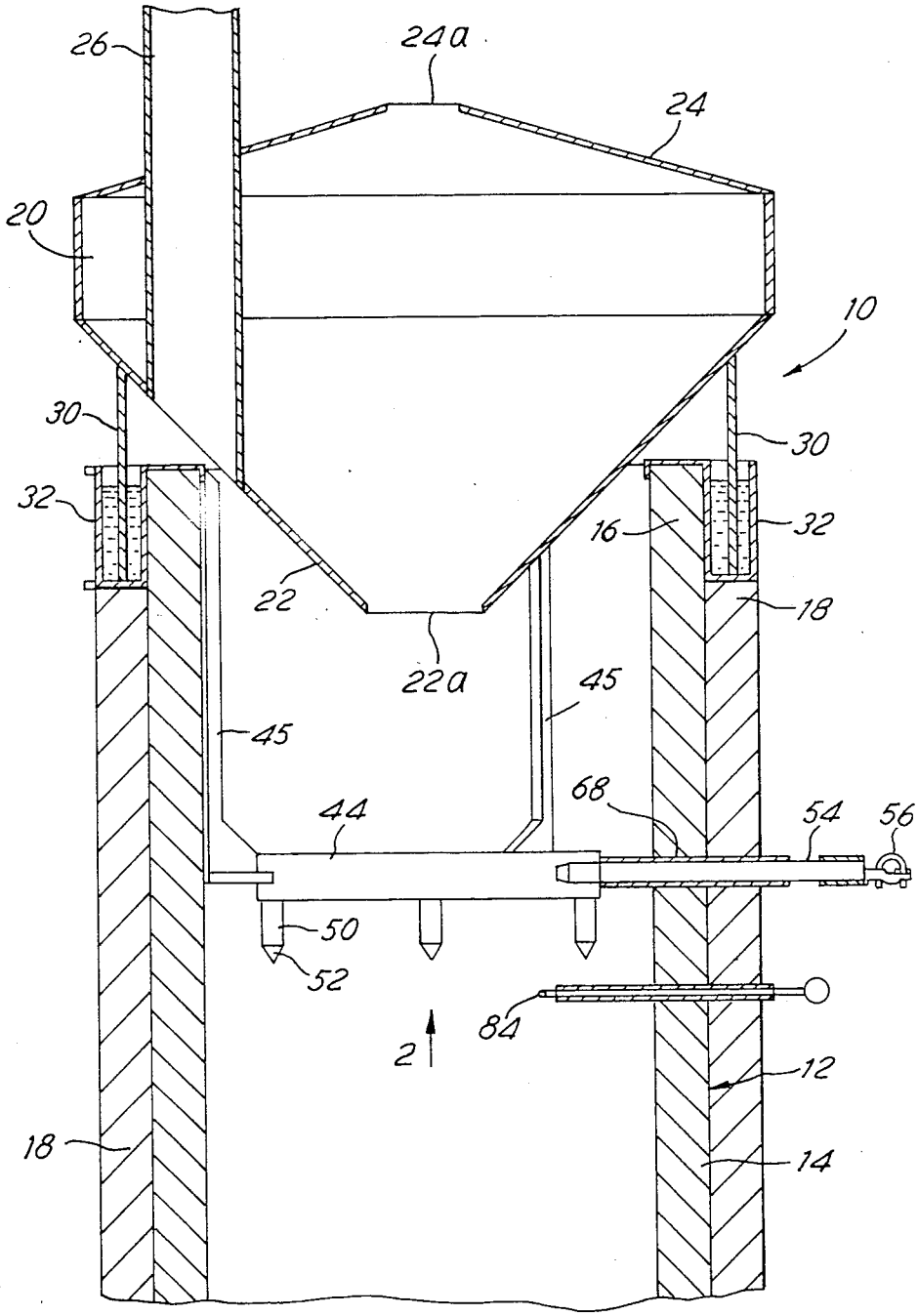

Referring now to the drawings, there is shown an furnace 10 for use in activating and re-activating carbon.

The furnace 10 comprises an elongated vertical circular section column 12 which is supported by a steel framework (described below). The column 12 comprises a pair of tubular refractory cement rings 14 and 16 which are laid one on top of the other. The column is externally insulated by a cylinder 18 of ceramic fibre.

At its upper end, the column 12 has a hopper 20 having a frusto-conical lower portion 22, a cylindrical mid-portion 20 and a frusto-conical upper portion 24 having a much larger cone angle. The smaller ends **22*a* and 24*a* of the frusto-conical portions 22 and 24 are open to provide feed openings. A vertical flue 26 passes through the hopper 20. A skirt 30 depends from the lower portion 22 and surrounds the upper portion of the column 12. A water gutter 32 is provided at the upper end of the column 12 and this receives the lower edges of the skirt 30 to provide a water seal therefor and also to support the hopper 20 slightly spaced off the upper edge of the column 12**.

At its lower end, the column 12 has a discharge funnel 34 leading to an outlet tube 36 that is controlled by an outlet valve 38. This tube 36 carries a hood 40 below which may be received a removable drum 42 that receives the discharge from the column 12.

Between and respectively close to the upper and lower ends, the column 12 contains a pair of electrodes 44 and 46, the former being of course axially spaced above the latter. The electrodes 44 and 46 each comprise a horizontal grid cut from a plate of graphite material.

Figure 2:
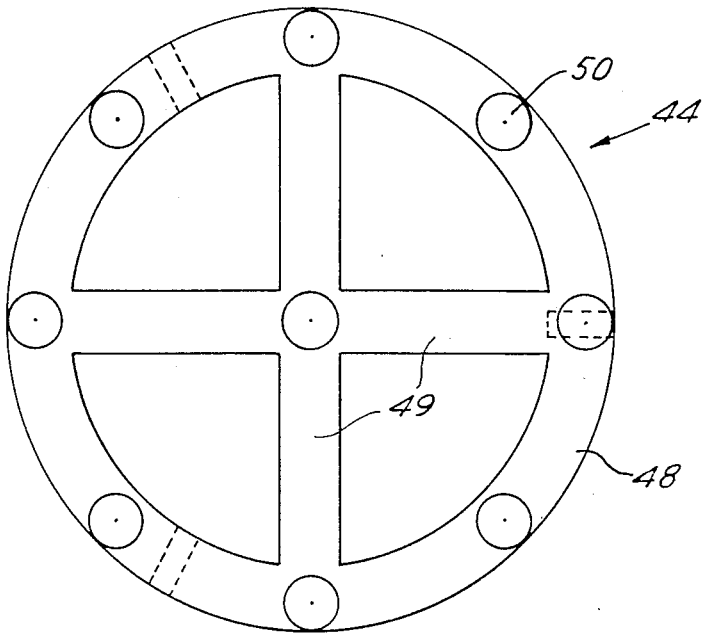
Figure 3:
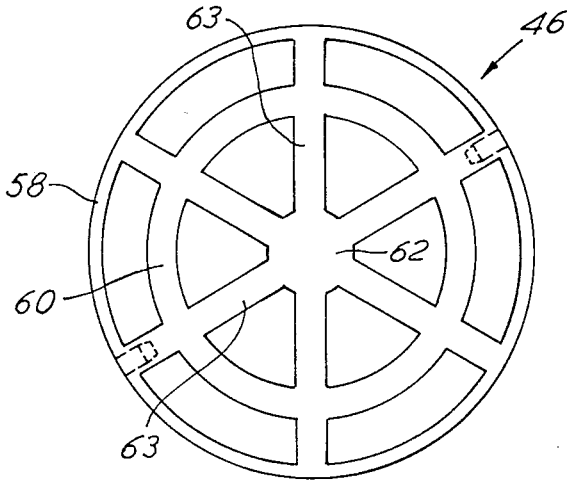

The upper electrode 44 (see FIG. 2) consists of an annular ring 48 joined by a pair of diametrical members 49 arranged at right angles to one another. It is carried by a number of "T"-section supports 45 that are supported by the wall of the column 12. A number of cylindrical prongs 50 depend from the ring 48, each having a pointed end 52. Eight equispaced prongs 50 depend from the ring 48 and a further prong 50 depends from the junction between the members 49 at the centre of the upper electrode 44. A single electrode connector 54 extends from the electrode 44 through the column 12 and has a clamp 56 at its end for connection to a power cable (not shown) connected in turn to a source of rectified three phase alternating electric power at high amperage (say 480 amps) and low voltage (say 200 volts).

The lower electrode 46 consists of two co-axial rings 58 and 60 and a central disc-like section 62. Six equispaced diametral members 63 joint the rings 58 and 60 and the disc 62. Two electrode connectors 64 extend from the outer ring 58 through the column 12 and each has a clamp 66 for connection to a DC power cable of opposite polarity to that referred to above.

The electrode connectors 54 and 64 are each sheathed in a robust ceramic insulator 68.

The upper and lower electrodes 44 and 46 both extend over the entire area of the column 12 and the cross-sectional area of the openings through and about the electrode is approximately 51% of the internal cross-sectional area of the column.

Below the lower electrode 46 is a steam injection ring 70 having downwardly directed jet openings at about 30° to the horizontal. This steam ring 70 is located directly below the inner ring 60 of the lower electrode 46 and is supported by vertical support members 71 carried by the discharge funnel 34. It has a diameteral cross-piece 72. A steam pipe 74 leads to the centre of the cross-piece 72. The steam pipe 74 has an inclined continuation 76 which passes through the sides of the funnel 34 to a main steam control valve 78 which is connected by another pipe (not shown) to a source of steam. The main steam control valve 78 is also connected through an additional steam pipe 80 containing a steam trap to the discharge tube 36 below the outlet valve 38.

Below the steam injection ring 70, and centrally located relative to the discharge funnel 34 is an equalising cone 82 through the centre of which the steam pipe 74 passes. The vertical position of the cone 82 is adjustable to enable the flow of the granular material to be adequately controlled.

Thermocouples 84 are provided at spaced locations along the length of the column 12.

The upper end 86 of the discharge funnel 34 is releasably bolted to the remainder of the funnel 34 and has a channel shaped surround 88 at its upper end in which is received the lower edges of the column 12. A number of vertical supports 90 are provided on the inside surface of the column 12 and these are attached to funnel and the lower electrode 46 to support the electrode on the funnel 34.

The column 12 is carried on a robust steel support frame 94 consisting of steel channel and "I"-beams 96 and 98 being supported thereon by a refractory insulating ring 100 on which rests the lower surface of the surround 88.

An enclosed tubular feed leads from a heater which dries the granules and this feed provides a feed to the hopper 20. The granules are continuously fed from the hopper 20 into the column 12.

The outlet valve 38 is arranged so that the carbon granules pass continuously and slowly through the column 12. Between the electrodes 44 and 46 the granules will serve as a resistance path for the power and the granules will thus be heated to be activated or re-activated. After the heated granules pass the lower electrode 46, these will be cooled by the steam passing from the injection ring 70. A further quench is provided for the granules by the steam introduced into the outlet tube 36.

I have found that with the granules passing through the column continuously, these will not be too tightly packed and accordingly the resistance of the column of granules will be high permitting substantial power to pass therethrough. Furthermore the steam, the gasses provided by the reaction mentioned above, and the volatiles passing up the column will improve the heat transfer through the granules for the activating or re-activating process. These gasses will pass up the column 12 and will escape through the flue 26 and may be burnt at the outlet therefrom.

In addition, because of the provision of the pointed prongs 50, the flow of the granules below the upper electrode 44 will be such that there will not be spaces in the column of granules below the upper electrode 44 which might lead to sparking from the electrode which would result in the formation of considerable hot spots as well as erosion of the electrode. I have further found that the furnace as above described is efficient and satisfactory in operation.

The furnace is particularly useful for activating or re-activating carbon for use in a carbon-in-pulp or carbon-in-leach process or for use in for other purposes such as for water purification.

The dimensions of the column may vary as required. In one embodiment the internal diameter of the column is 750 mm, the vertical distance between the electrodes is 2,500 mm and there is a distance of 750 mm between the upper electrode and the upper end of the column. The power supply will be 200 volts and 480 amps. The furnace can treat up to about two hundred kilogrammes of granular activated carbon (GAC) per hour (or put another way four hundred liters of GAC per hour). It will be noted that this furnace treats 1.00 kilogramme of GAC per 0.48 kilowatt hours of power supplied. The temperature of the GAC granules as fed to the column is 120° C. This increased to 300° C. just below the upper electrode 44, it increases to about 800° C. between the electrodes which temperature is maintained until the granules are quenched by the steam.

I have found that it is important to locate the cone 82 with considerable accuracy in order to control the flow of granular materials through the column so that it maintains a substantially flat and horizontal front. This is desirable in order to have an even temperature across the column which in turn provides for more even activation of the granules and more efficient use of power.

I have found that the furnace 10 works very satisfactorily and economically with granular activated carbon of sizes falling within the range +1.18 mm −2.36 mm although it is believed that the furnace can be used with the sizes of GAC.

The results of treatment in the furnace described above over a lengthy period of use have been on average to return the GAC to an activity of 90% of that of virgin GAC.

The invention is not limited to the precise constructional details hereinbefore described and illustrate in the drawings. For example, the apparatus may operate as a batch production device. The electrodes may comprise graphite rods or indeed may be of other construction. The various dimensions, power supply and operating characteristics may be changed as desired. If desired the GAC can be pre-screened before being fed into the hopper. The electrical power could be single phase alternating current power or may be other DC power.

I claim:

1. Apparatus for treating particulate material comprising:

(a) a single vertical column;

(b) upper and lower electrode means arranged at vertically spaced locations within the column, the electrode means extending across the column and being so constructed that the particulate matter can pass with ease through the electrode means; and (c) prongs having pointed lower ends depending from the upper electrode to minimise the effect of sparking across the material.

2. Apparatus as claimed in claim 1 wherein the electrodes are constituted by graphite plate which is punched to form the grid structure.

3. Apparatus for treating particulate material comprising:

a. a single vertical column;

b. an upper electrode means within the column, the said upper electrode means extending across the column and being constructed so that the particulate material can pass therethrough;

c. a plurality of prongs depending from the said upper electrode, the said prongs being cylindrical and being arranged with their axis substantially vertical and terminating in pointed lower ends; and d. lower electrode means arranged within the said column at a location vertically spaced below the said upper electrode means, the said lower electrode means being constructed so that the particulate material can pass down the said column past the said lower electrode means.

4. Apparatus as claimed in claim 3 wherein the said electrode means comprises a circular annulus, the outer diameter of which is less than the inner diameter of the said column.

5. Apparatus as claimed in claim 4 wherein the said upper electrode means further comprises a pair of members extending at right angles to one another diametrically across the said annulus.

6. Apparatus as claimed in claim 5 wherein one of the said prongs depends from the junction between the said diametral members and the remaining prongs depend from the annulus.

* * * * *